US005081893A

United States Patent [19]

Broadmoore

[11] Patent Number: 5,081,893

[45] Date of Patent: Jan. 21, 1992

[54] STRIKER SOLENOID ASSEMBLY FOR PLAYER AND REPRODUCING PIANOS

[76] Inventor: Laurence G. Broadmoore, 908 Glenoaks Blvd., #3, San Fernando, Calif. 91341

[21] Appl. No.: 554,695

[22] Filed: Jul. 19, 1990

[51] Int. Cl.[5] ..... G10F 1/02

[52] U.S. Cl. ..... 84/19

[58] Field of Search ..... 84/3, 13, 19, 20, 21, 84/22, 23

[56] References Cited

FOREIGN PATENT DOCUMENTS 893783 2/1972 Canada ..... 84/19

*Primary Examiner*—L. T. Hix
*Assistant Examiner*—Howard B. Blankenship

[57] ABSTRACT

A solenoid stack for a piano incorporating an array of striker solenoids, each of which includes an outer shell, a coil disposed within the outer shell and having an axial passage extending through its entire length, an inner shell within the coil and a slug moving axially within the inner shell in response to selective energization of the coil. The slug is provided with a passage through its length, and the passage includes an internally threaded section which a threaded push rod engages such that an upper end extends above the slug and carries a pusher tip. An adjustable stop member is provided at the bottom of the slug to limit the stroke of each individual solenoid assembly. A mounting plate includes an array of apertures for receiving the striker solenoid assemblies (in threaded, press-fit or the equivalent engagement) within the keybed such that each solenoid assembly is juxtaposed with respect to an individual keytail. In one variation, the mounting plate is made up of a series of modules (each with two or more solenoid-receiving apertures) having offset fore and aft sections. A "top hat" mounting assembly is also disclosed by the use of which a unitary player assembly may be obtained.

20 Claims, 3 Drawing Sheets

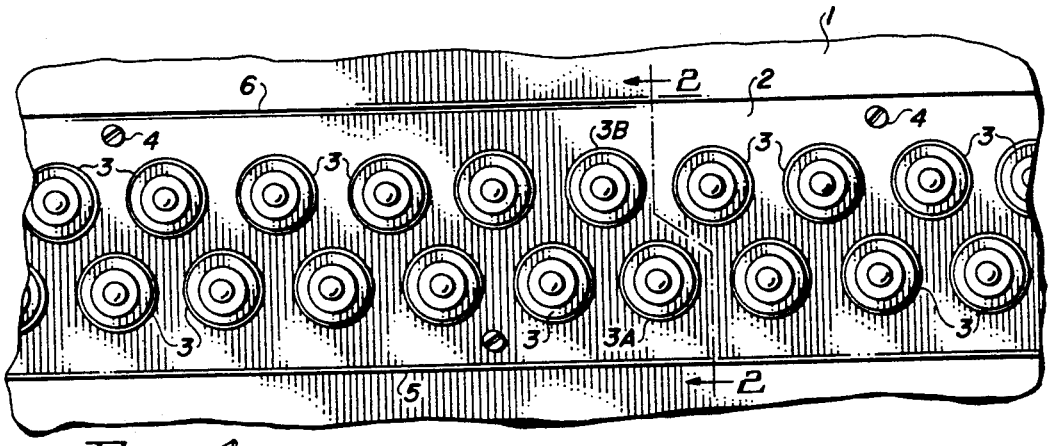
FIG. 1
FIG. 2
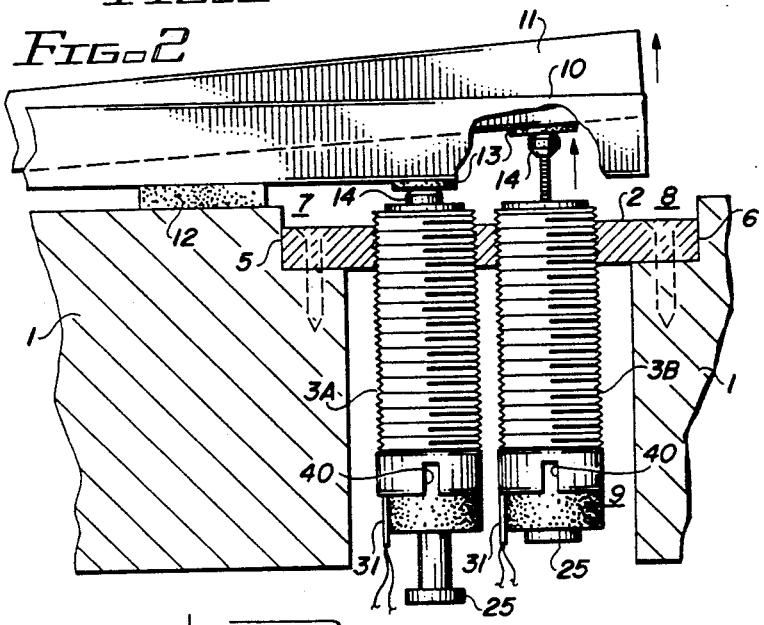
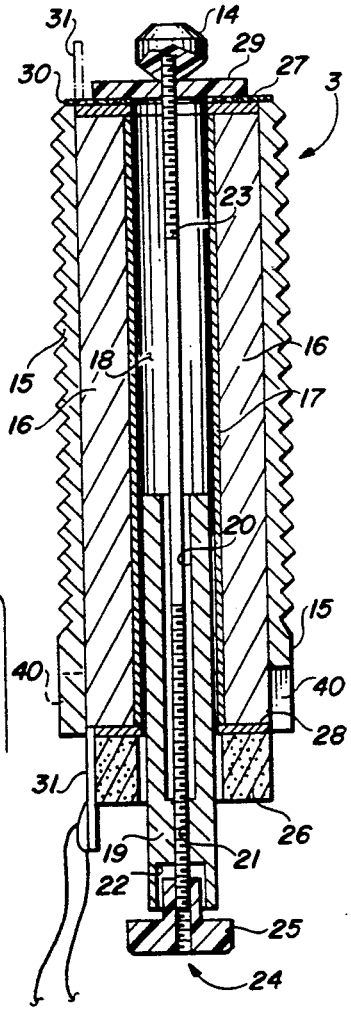
FIG. 3
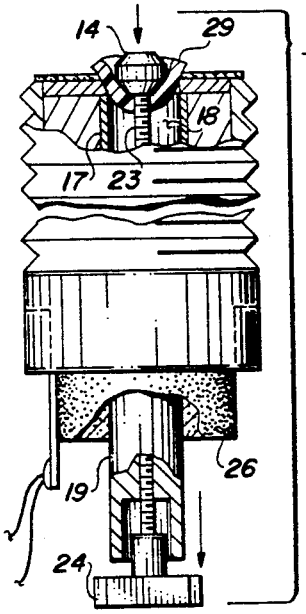
FIG. 4
FIG. 22
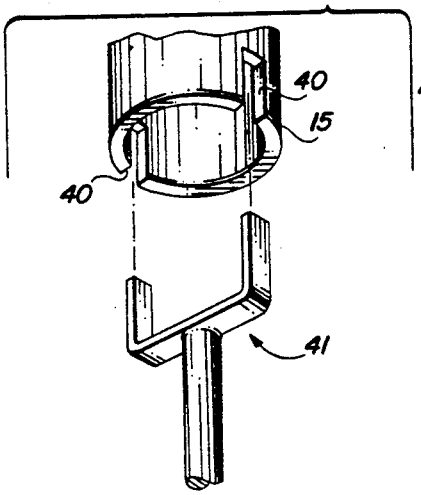

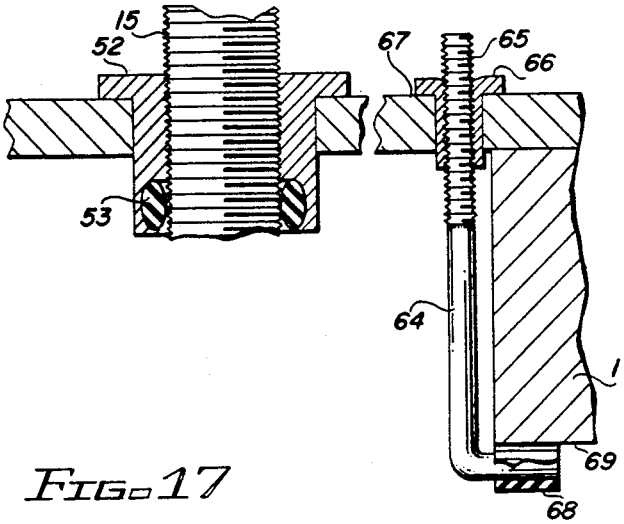
FIG. 17
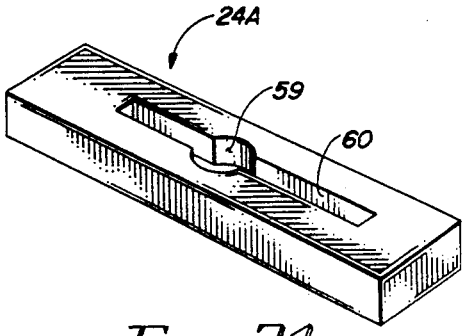
FIG. 21
FIG. 10
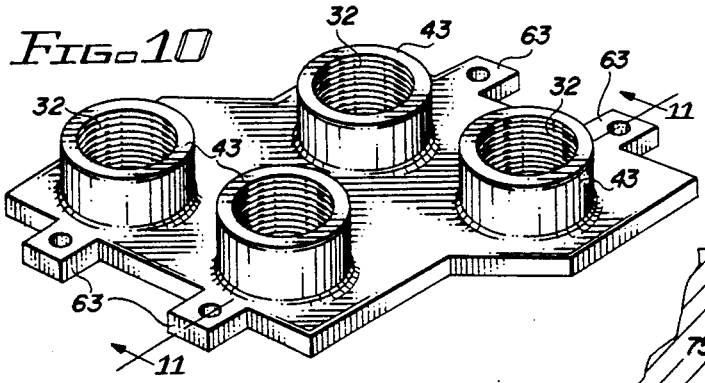
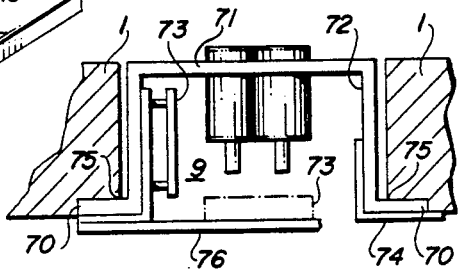
FIG. 23
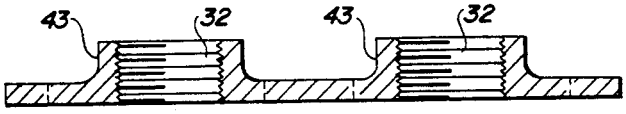
FIG. 11
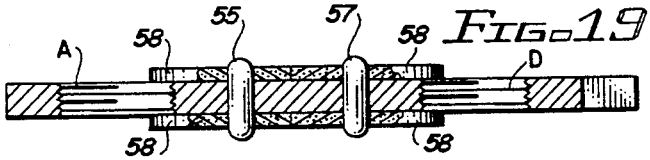
FIG. 19
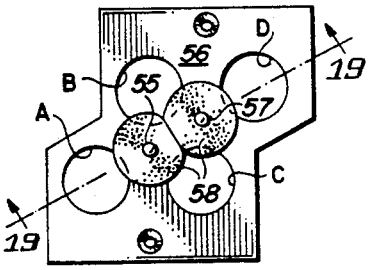
FIG. 18
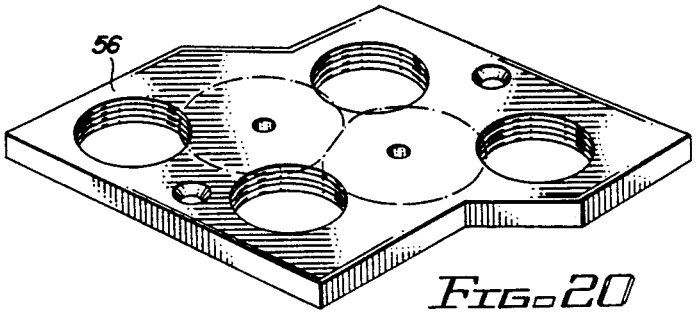
FIG. 20

STRIKER SOLENOID ASSEMBLY FOR PLAYER AND REPRODUCING PIANOS

FIELD OF THE INVENTION

This invention relates to the art of automatic musical instruments and, more particularly, to a striker solenoid and solenoid mounting assembly for driving the action of a piano under the control of solenoid driver electronic circuitry.

BACKGROUND OF THE INVENTION

Those skilled in the art of automatic musical instruments are well aware of the various mechanisms which have been developed over the years to actuate the action of player and reproducing pianos. (It will be understood that a reproducing piano is a highly developed refinement of the player piano in that hand playing is closely reproduced by carefully controlling the dynamics and pedaling of the reproduction so as undertake to replicate the original performance of the artist.) For many years, the preferred actuator mechanism in player and reproducing pianos was the striker pneumatic array (known in the art as a "stack") operating under control of a suitable valve system reading a piano roll traveling across a tracker bar to selectively admit vacuum to individual striker pneumatics, thereby causing them to selectively collapse and correspondingly strike the individual action notes. These mechanisms reached their zenith in the best of the Welte, Ampico and Duo-Art reproducing systems installed in fine pianos. The Welte, Ampico, Duo-Art and a few other less well known reproducing systems included control units which provided instantaneous control of the vacuum intensity in separate bass and treble sections in order to control the dynamics of each note struck. By this arrangement, remarkable reproduction of an original performance can be obtained if the reproducing equipment and piano are in fine condition.

In recent years, several player and reproducing systems have employed striker solenoid stacks in place of the striker pneumatics. Such systems have included the Pianocorder TM, Disklavier TM, Pianodisk TM, Bosendorfer SE TM ("Stahnke-Equipped") and Pianomation TM. The complex and expensive Bosendorfer SE system is widely thought to provide instant playback (and, of course, long term preservation) which is virtually indistinguishable from the original performance. The Pianomation system, also designed by Wayne Stahnke, is capable of providing a performance only slightly inferior in power to that of the Bosendorfer SE and, in some respects, offers even further refinement in nuance capability in a relatively inexpensive package suitable for retrofit into an existing instrument.

Those skilled in the art will understand that all these solenoid-actuated stacks suffer from as many as seven problems more or less in common with the old pneumatic stacks: viz.:

1) they are noisy due to either the use of solenoid coil bobbins which are dimensionally too unstable to permit a close tolerance between coil and slug or because the distance between the coil and keytail is so great that side forces on the necessarily long wire connecting solenoid slug and pusher tip make a guide necessary, that fact rendering it difficult to achieve close concentricity between this guide and the solenoid bore such that a loose fit is needed to prevent sticking of the slug in its coil tube;

2) they are difficult to install due to the need to: A) extensively modify a grand piano's pedal hardware to accommodate pedal linkages, different for each model of piano and B) make and slot a box and apply noise-muffling felt to the box;

3) in grand pianos, they are physically situated beneath the keybed in such a downwardly depending manner that the graceful lines of the piano are seriously compromised;

4) they require a more or less complex cohesive structure or framework in which to mount the key actuators. In order to have adequate power, the solenoids are too large to fit above the keybed; therefore some designers have placed the solenoids below the keybed such that, even in the typical front-to-back staggered arrangement, they still cause an unsightly downward protrusion from the keybed;

5) some designs do not allow the individual removal and replacement of a solenoid without disturbing others;

6) In retrofit form, it is difficult, time consuming and awkward to adjust the solenoids laterally to their respective keys; and 7) conventional vertically staggered stacks, which are not horizontally staggered also, placed a geometric limitation on the size of the coils used, thus inappropriately limiting the fortissimo capability of the system.

With great care in designing (including the incorporation of sound deadening material) and utilizing a solenoid-concealing housing, the noisy character of the stack can be diminished to a tolerable, if not completely acceptable, level; but this expedient, if anything, introduces a further intrusion on the aesthetics of the piano. In conjunction with the invention of my copending application Ser. No. 07/554,740, filed on even date herewith and entitled "SOLENOID MOUNTING SYSTEMS FOR PLAYER AND REPRODUCING PIANOS", it is to the interactive solution of all seven of the above problems that my invention is directed.

OBJECTS OF THE INVENTION

Thus, it is a broad object of my invention to provide an improved solenoid stack for use in player and reproducing pianos.

It is another object of my invention to provide such an improved solenoid stack which is inherently very quiet in operation.

In another aspect, it is an object of my invention to provide such a solenoid stack which is easy to install.

In still another aspect, it is an object of my invention to provide such a solenoid stack which is substantially hidden in the keybed and thus does not intrude upon the aesthetics of a grand piano.

In yet another aspect, it is an object of my invention to provide convenient access to individual note solenoids or the coils thereof or both for removal for servicing or replacement without disturbing other note solenoids or removing the solenoid stack.

In yet another aspect, it is an object of my invention to provide means for ensuring the long term retention of a plurality of adjustments associated with each solenoid in the stack.

In its retrofit embodiments, it is an object of my invention to make the alignment of the solenoids constituting the stack with their respective keytails relatively easy and quick, and, in one of my embodiments, this alignment can be performed from below.

SUMMARY OF THE INVENTION

Briefly, these and other objects of my invention are achieved by a solenoid stack for a piano incorporating an array of striker solenoid assemblies, each of which includes a generally cylindrical outer shell or casing which may be threaded along at least a portion of its length, a coil concentrically disposed within the outer shell and having an axial passage extending through its entire length, an inner shell concentrically disposed within the coil, steel washers attached to the inner shell to provide pole pieces and thus a magnetic path for the solenoid and simultaneously forming a bobbin upon which the coil wire is wound and a slug adapted for coaxial translation within the inner shell in response to selective energization and deenergization of the coil.

In the case of mechanisms whose electronics systems do not include other provisions for control of minimum application of force to the piano keys by varying the power applied to solenoid coils and/or precisely limiting the travel of solenoid slugs, the slug may be provided with a coaxial passage through its length, which passage may include an internally threaded section or threaded insert through which a push rod, typically threaded along its entire length, may pass such that a lower end of the push rod extends below the slug and an upper end extends above the slug. A pusher tip is affixed to the upper end of the push rod, and an adjustable stop member of special design may be provided at the bottom of the slug to appropriately limit the stroke of each individual solenoid assembly.

In the event that the electronic system controlling the solenoids contains automatic, electronic or electrical adjustments for soft playing, limiting of solenoid travel or lost motion between the solenoid pusher tip and the underside of the key, certain provisions for adjustment may be eliminated. In such cases, solenoids may be made with a rigid connection between the pusher tip and push rod and between the solenoid slug and push rod in order that these three components are a single, rigid assembly. Solenoid casings may be rigidly or permanently affixed to the mounting plate or plates so that, if adjustment of the pusher tip height is necessary in order to compensate for wear, it is accomplished through other means, such as a screw adjustment done from above. Alternatively, this adjustment may be effected by threading a thin nut (perhaps with a rounded lower surface) onto the push rod immediately below the pusher tip, with a flexible washer below this nut, resting upon the rim of a hole in a mounting plate or top of the solenoid; thus, the lost motion adjustment may be performed by rotating the solenoid slug while pulling the slug downwards, the friction between the nut, the washer and its seat locking the nut in position while the threaded push rod is turned relative to it, thus moving up and down. Consequent minute changes to the pianissimo level (due to changes in the location of the slug relative to its coil) are then automatically compensated when pianissimo is adjusted electronically. Gross adjustments may be obtained in the selection of push rod length and vertical location of solenoids and mounting plate or plates. (It is not mandatory for any adjustment to be made to compensate for variations in distance fore and aft between the pusher tips and the key fulcrums which result from the horizontal staggering of solenoids. The throw of all solenoids may be set alike and made non-adjustable, regardless of resultant lost motion, without materially affecting performance provided that this lost motion does not exceed an appropriate amount on the order of 3/32".)

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a partial plan view of the keybed of a grand piano, modified to receive the subject solenoid stack, and particularly illustrating a first embodiment of a solenoid mounting plate component;

FIG. 2 is a partial cross sectional view taken along the lines 2—2 of FIG. 1 and further including illustrations of adjacent keytails and the placement and orientation of the striker solenoids and their interaction with the keytails of the piano action;

FIG. 3 is a detailed cross sectional view of a presently preferred embodiment of the special purpose striker solenoid employed in the subject system;

FIG. 4 is a partially broken away view similar to FIG. 3 illustrating the striker solenoid with its slug pulled downwardly into a temporary adjustment position;

FIGS. 10 and 11, respective three-quarter and cross sectional views, illustrate the manner in which the length of internal threads in the solenoid-receiving apertures in the mounting plate structure may be increased to improve the strength and reliability of the threaded engagement between the solenoid assemblies and the mounting plate structure;

FIG. 17 shows a fourth embodiment of a feature directed to reliably increasing the friction of the threaded engagement between a solenoid assembly and the mounting plate structure and also illustrates an alternative arrangement for holding the mounting plate structure in place within the keybed;

FIGS. 18, 19 and 20, respective plan, cross sectional and three-quarter views, show a fifth embodiment of a feature directed to reliably increasing the friction of the threaded engagement between a solenoid assembly and the mounting plate structure;

FIG 21 is a three-quarter view of a variant configuration for the stop member component incorporated into the striker solenoid;

FIG. 22 is a fragmentary view of the solenoid outer shell and of a tool, the shell and tool being mutually adapted to facilitate screwing each solenoid assembly into the correct vertical position during the stack adjustment process; and FIG. 23 is a cross sectional view of a stack according to the invention employing a "top hat" mounting plate structure.

DETAILED DESCRIPTION OF THE INVENTION

Figure 5:
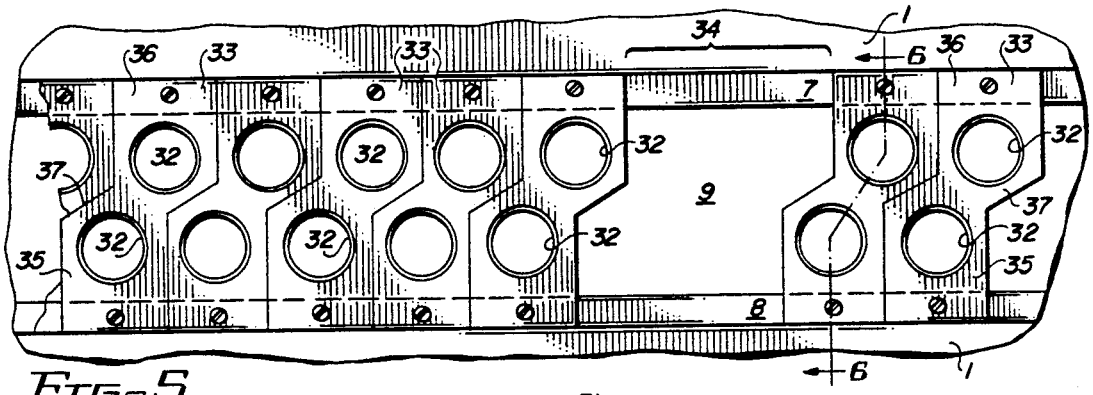
FIG. 5 is a view similar to FIG. 1 showing a variant configuration for the solenoid mounting plate component in which it is subdivided into a plurality of individual modules, each supporting a pair of adjacent striker solenoids.

Referring first to FIG. 1, there is shown a partial view of a grand piano keybed 1 viewed from above and illustrating an integral solenoid mounting plate 2 extending transverse the keybed. The mounting plate 2 supports an array of upwardly-directed striker solenoids 3 which are disposed with the centerlines of adjacent ones staggered fore and aft to permit the necessary close lateral spacing which, it will be understood, places one striker solenoid beneath the keytail of an individual piano note. (Those skilled in the art will understand that the transverse rows may be more than two in number if necessary to accommodate a given solenoid design.) The mounting plate 2 lays within a slot prepared in the keybed 1 and is supported at or below the upper surface thereof by resting its fore and aft edges within rabbeted regions of the keybed as will become more clear below. The mounting plate 2 is held in place with suitable mounting screws 4 or the equivalent distributed along the length of the mounting plate proximate the fore and aft edges thereof.

Thus, referring now to FIG. 2, it will be seen that the fore 5 and aft 6 edges of the mounting plate 2 reside in respective rabbeted regions 7, 8 provided in the upper surface of the keybed 1 such that the solenoids 3A, 3B, supported by the mounting plate, depend downwardly into a transverse slot 9 cut into the keybed. (As will be discussed more fully below, apertures through the mounting plate 2 may be internally threaded to receive externally threaded outer shells of the striker solenoids.) Keytails 10, 11 of adjacent notes are shown, normally supported slightly above the keybed 1 by backrail felt 12 (which those skilled in the art will recognize has been relocated slightly forwardly; i.e., toward the balance rail), with striker solenoid 3A positioned beneath keytail 10 and adjacent striker solenoid 3B positioned beneath keytail 11 and disposed slightly aft of solenoid 3A.

In FIG. 2, striker solenoid 3A is not energized such that keytail 10 is in its rest position; however, striker solenoid 3B is illustrated in the energized state to show how it has driven keytail 11 upwardly to cause the associated note to sound. Felt pieces or underfelts 13 glued to the bottom of the individual keytails are positioned to deaden the sound of the pusher tips 14 as they individually actuate their associated keytails.

Important components of the subject system are the special purpose solenoids which have a number of features. Attention is now directed to FIG. 3 which shows, in cross section, details of an exemplary striker solenoid assembly 3. A generally cylindrical outer shell or casing 15 is externally threaded along at least a portion of its length in order that it can be screwed into the mounting plate an amount appropriate for each individual note. The outer shell 15 encompasses a concentric coil 16 and an inner shell 17 concentrically disposed within an axial passage 18 through the coil. Upper 27 and lower 28 metal washers, crimped or otherwise secured in place, serve to hold the coil subassembly together.

A slug 19 is positioned for coaxial translation within the inner shell 17 in response to selective energization and deenergization of the coil 16. The slug 19 is provided with a coaxial passage through its entire length, and this coaxial passage includes an internally threaded passage section 21 and, in this embodiment, a lower passage section 22 which has a larger diameter than the threaded passage section.

A push rod 23 (threaded along at least a portion of its length and conveniently along its entire length) is screwed completely through the internally threaded section 21 of the passage 20 such that its lower end extends into and through the lower passage section 22. The pusher tip 14, functioning as a thrust member against a keytail as previously described, is affixed to the upper end of the push rod 23. A generally inverted t-shaped stop member 24 has an internally threaded aperture which threadedly engages the lower region of the push rod 23. The travel-limiting section 25 of the stop member 24 has a width which exceeds the inside diameter of the inner shell 17 in order to perform its office. A thick, and relatively soft (e.g., felt), sound deadening washer 26 may be advantageously fixed to the lower metal washer 28 to provide a seat against which the stop member abuts during solenoid energization. The provision of the stop member 24 may not be necessary in installations in which positive travel limit is achieved by stop felt placed under the whippen rail in a grand or above the rear of the keys in an upright.

Surrounding the push rod 23 and situated beneath the pusher tip 14 above the upper metal washer 27 is a resilient washer 29 (fabricated, for example, from neoprene) which performs two functions. First, it serves to further deaden the mechanical noise associated with the return to the rest position of a just-deenergized striker solenoid. Second, it facilitates making an important individual adjustment to each striker solenoid as will be described more fully below. A thin felt washer 30 may be fixed to the upper surface of the upper metal washer 27 to further limit mechanical noise. Coil terminals 31 ma be positioned at the bottom of the coil assembly as shown or at the top as shown in phantom for installations in which such a position is advantageous.

It will now be understood that several individual solenoid assembly adjustments are available to optimize the performance of each note in the instrument. First (and also referring briefly again to FIG. 2), the threaded engagement between the outer shell 15 of the striker solenoid and the apertures of the mounting plate 2 permit individual installation and adjustment such that the solenoid pusher tip 14 just engages the felt piece 13 of the associated keytail (10 or 11) without raising it off the backrail felt 12 when the solenoid is deenergized.

Second, pianissimo response for each note may be adjusted by screwing the slug 19 up or down along the push rod 23 in order to establish the rest position (and hence set the sensitivity of response to the weakest usable electromagnetic field when the coil 16 is energized) of the slug within the coil. Third, the stroke length of each individual striker solenoid may be adjusted to be correct for the individual note of the instrument action by running the stop member 24 up or down on the lower end of the push rod 23. This prevents the key from being unintentionally lifted off the balance rail when its solenoid is energized.

Figure 8:
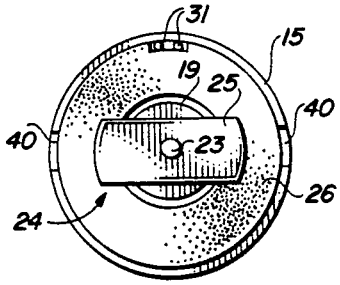
FIG. 8 is a bottom view of the striker solenoid shown in FIG. 3.

Referring briefly to the bottom view of FIG. 8, it will be seen that the stop member 24 has a symmetrically elongated inverted t-shape disposed about the push rod 23. This shape facilitates grasping the stop member during the adjustment process since the solenoid assemblies are closely spaced.

Figure 9:
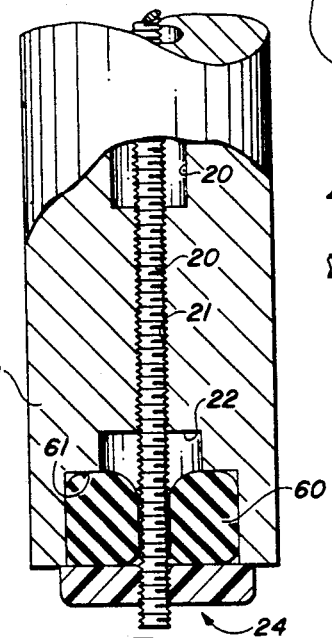
FIG. 9 is a partially broken away cross sectional view of the lower portion of a slug component of the striker solenoid and illustrating a variation directed to insuring the reliable adjustment of a stop member component's position.

In FIG. 9, a variant of the throw adjustment arrangement is shown which employs a resilient O-ring 60 emplaced in an annular expanded region 61 of the lower passage section 22. The inside diameter of the O-ring is selected to frictionally engage the push rod 23 and thus secure the integrity of the throw adjustment. In this variation, no vertical portion of the stop member 24 is necessary.

Another variation of the stop member 24 is shown in FIG. 21 as 24A. A central aperture 59 is joined to slots 60 which extend radially with respect to the aperture 59 and longitudinally with respect to the body of the stop member 24A. The aperture 59 is made slightly undersize to receive the push rod 23 only be flexing the outer walls of the stop member outwardly along the lengths of the slots 60. This arrangement significantly increases the friction of the threaded engagement between the stop member and the push rod 23 and eliminates the necessity for providing the counter-bored lower passage section 22 (FIG. 3) in the slug 19 which is therefore easier to fabricate.

In order to make the pianissimo adjustment, it is necessary to constrain the push rod 23 from rotating while the slug 19 is rotated to adjust its axial position on the push rod and hence within the coil. However, this adjustment can only be conveniently made with the instrument fully assembled such that access to the pusher tip 14 (the push rod can be stopped from rotating only by constraining the pusher tip against rotation) is inaccessible. The special configuration of the solenoid assembly nonetheless renders this adjustment a simple matter.

Referring to FIG. 4, the slug 19 may be pulled downwardly (from beneath the instrument) to draw the pusher tip 14, about which is wrapped the resilient washer 29, into the aperture 18 define. by the inner shell 17. Thus, the resilient washer 29 frictionally engages both the inner wall of the inner shell 17 and the pusher tip 14 which is thus constrained against rotation to correspondingly hold the push rod 23 against rotation. Then, it is only necessary to turn the slug 19 to make the desired adjustment after which it may be pushed upwardly to release the pusher tip 14 and resilient washer 29 back to their normal rest position shown in FIG. 3. This process may be repeated as necessary to set the pianissimo response of the individual note to be essentially perfect, a condition well known to those skilled in the art to be of fundamental importance to good musical reproduction.

Figure 6:
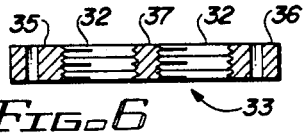
FIG. 6 is a cross sectional view taken along the lines 6—6 of one of the modules illustrated in FIG. 5.

Those skilled in the art will understand that the keytails of pianos are typically grouped into three or four separated sections and that pianos vary on the break point positions and in other dimensions. As a result, the unitary mounting plate 2 of FIG. 1 must sometimes be adapted to fit a given instrument. In order to obtain increased versatility, the mounting plate may be subdivided into a plurality of modules or segments 33 such as shown in FIG. 5. Referring also to FIG. 6, each individual module includes two, three or more laterally and fore and aft staggered, internally threaded apertures 32 and have left and right edges complementarily configured to permit interlocking. Thus, for example, a break at position 34 may readily be accommodated. In addition, it will be understood that, if desirable for rigidity purposes, the slot 9 may be interrupted in the break region 34.

It will be seen that each module 33 has a fore section 35, an aft section 36 and an intermediate section 37 with the fore and aft sections being laterally offset such that the intermediate section is angled and includes at least portions of the two internally threaded apertures 32. Those skilled in the art will appreciate that it is desirable to keep the fore and aft length of the modules 33 as short as reasonably possible in order to correspondingly limit the necessary width of the slot 9 and maintain the rigidity of the keybed 1. However, with proper reinforcement of the keybed, it is possible to employ solenoids of any appropriate diameter in any necessary geometric configuration, as well as to provide room for the containment of electronic or other components within the solenoid mounting structure by making such a structure of larger size.

Figure 7:
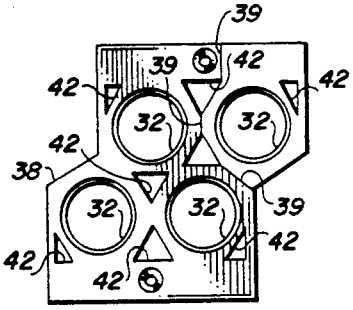
FIG. 7 is a plan view of another embodiment of an individual module which supports four successive striker solenoids and which may optionally incorporate ventilating passages.

FIG. 7 shows a variant module or segment 38 which is wider than the module 33 of FIGS. 5 and 6 and accommodates four threaded apertures 32. It has been found that this quad version is a good compromise between versatility and the necessity of installing the necessary number of modules. Another aspect of cooling the solenoids is convective air flow around them, and upward air flow across the solenoids may be substantially enhanced by the provision of apertures 42 in any convenient configuration.

Consideration must be given to the material from which the mounting plate/modules are fabricated since the solenoids heat up substantially in use, and the fit between the mounting plate and the solenoids must be maintained sufficiently tight as to not permit the previously carefully set individual vertical positions of the solenoids to change through loose fit and vibration. Thus, a material should be selected which either closely matches the temperature coefficient of the solenoid assemblies or exhibits both a small temperature coefficient and a certain resilience to ensure that the solenoids can be turned, but are securely grasped.

Since it is necessary to have this threaded fit somewhat tight to maintain the adjustment, it is desirable to provide a ready agency for screwing/unscrewing the individual solenoid assemblies into the mounting plate. Referring again briefly to FIG. 2 and particularly to FIG. 22, two or more circumferentially distributed notches 40 may be provided in the bottom of the outer shell 15 of the solenoid assembly for engagement with a complementarily shaped tool 41 to facilitate this operation.

Those skilled in the art will appreciate that the important cooling function can be further enhanced by using the mounting plate structure as a heat sink. Since aluminum is an easily worked metal and has high heat conductivity, it makes a good heat sink and would seem to be ideal as a mounting plate material except for the fact that it has a high temperature expansion characteristic which is also quite different from that of steel. However, it has been found that aluminum (or, for that matter, other suitable metals such as steel or even brass) can be employed as the plate material while still maintaining the long term integrity of the vertical adjustment to the individual solenoid assemblies by applying one or more of several innovative approaches to securing the adjustments.

FIGS. 10 and 11 illustrate a quad module which incorporates mounting tabs 63 to further increase the mounting versatility of the module. (Note the optional provision of score lines 39 to permit breakaway for accommodating an odd number section if space is particularly tight. If a flat mounting plate is used, it may be unnecessary to remove part of the mounting plate as one section may simply remain unused.) Also, in order to obtain increased thread length in the metal mounting plate structure for the external threads of the solenoid assembly to engage, the apertures 32 may be flared into an upturned lip 43 as shown in FIGS. 10 and 11 before they are threaded.

Figure 12:
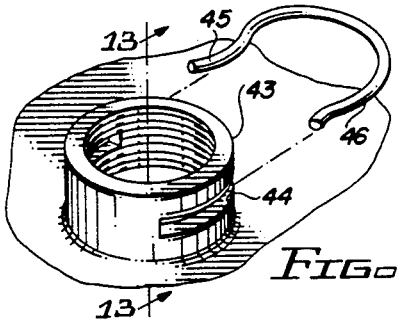
FIGS. 12 and 13, respective three-quarter and cross sectional views, show a first embodiment of a feature directed to reliably increasing the friction of the threaded engagement between a solenoid assembly and the mounting plate structure.
Figure 13:
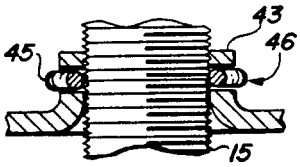

However, this technique alone is not sufficient to ensure the integrity of a solenoid assembly vertical adjustment. Attention is now directed to FIGS. 12 and 13 which show a first method for securing the individual adjustments. A milled slot 44 through the upturned lip 43 is provided around a limited portion of its circumference in order that one arm 45 of a horseshoe spring 46 extends through the milled slot and bears against the externally threaded outer shell 15 of the solenoid assembly. The resulting friction between the arm 45 and the shell 15 obtains the desired permanence to the vertical position adjustment. Either a single slot 44 may be provided, or a pair of diametrically opposed slots may be employed as shown.

Figure 15:
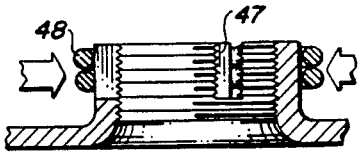
FIGS. 14 and 15, respective exploded three-quarter and cross sectional views, show a second embodiment of a feature directed to reliably increasing the friction of the threaded engagement between a solenoid assembly and the mounting plate structure.
Figure 14:
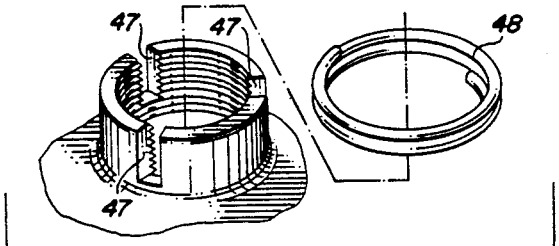

FIGS. 14 and 15 illustrate another embodiment of the adjustment retaining feature. A plurality of vertically oriented, circumferentially distributed slots 47 are provided in the upturned lip 43 and permit the arcuate lip sections (three in FIGS. 14 and 15) to be biased radially inwardly by a coil spring 48 to obtain the sought after tension fit between the threads in the mounting plate structure and the threads on the solenoid outer shell 15.

Figure 16:
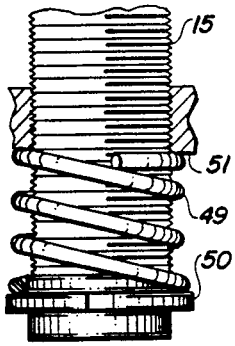
FIG. 16 shows a third embodiment of a feature directed to reliably increasing the friction of the threaded engagement between a solenoid assembly and the mounting plate structure.

FIG. 16 illustrates a third embodiment of the adjustment retaining feature. A compression spring 49 encompassing the solenoid outer shell 15 is captured in compression intermediate the lower face 51 of the mounting plate structure and a snap ring 50 situated near the bottom of the shell 15 which functions as a shoulder for the lower end of the spring 49 to bear against. Hence, increased and controlled friction is estab' .hed between the threaded members to secure the vertical adjustment once made.

FIG. 17 illustrates a fourth embodiment of the vertical adjustment retaining feature. It will first be noted that a thimble insert 52 is employed to increase the length of the threaded engagement. This is an effective alternative to the upturned lips shown in FIGS. 10 and 11, and it will be specifically understood that the several embodiments shown in FIGS. 12 through 17 can all use either the insert or the upturned lips or neither (as shown in FIGS. 2, 5, 6, 7, 18, 19 and 20) so long as adequate restraint against undesired change of the vertical adjustment is achieved.

It will be seen in FIG. 17 that a resilient O-ring 53 is captured within an annular groove in the insert 52 proximate its lower end. The internal diameter of the O-ring is selected to obtain an interference fit between the O-ring and the outer surface of the solenoid assembly as it is screwed into the insert 52. It will be understood that a corresponding O-ring may be employed for the same purpose in threaded apertures integral with the mounting plate structure.

Still referring to FIG. 17, an alternative, quick mount feature which eliminates the need for mounting plate screws is also shown. An L-member 64 is threaded in the region 65 at the end of its longer leg. An internally threaded insert 66 pressed into the mounting plate 67 receives the threaded portion of the L-member 64 and thus provides for its vertical position. On the short leg of the L-member 64, there is provided a resilient pad, such as a piece of tubing 68, which may be forced against the lower surface 69 of the keybed by appropriately screwing the L-member 64 into the insert 66 to thereby detachably fix the mounting plate component 67 in place.

FIGS. 18, 19 and 20 illustrate a fifth embodiment of the adjustment retaining feature which incorporates a somewhat different approach. The four solenoid-receiving apertures 54 can be considered to include two groups of three; i.e., apertures A, B and C and apertures B, C and D. A first pin 55 is driven through an aperture (sized to obtain a force fit) in the mounting plate 56 at a position equidistant from the centers of each of the apertures A, B, and C. Similarly, a second pin 57 is driven through an aperture in the mounting plate at a position equidistant from the centers of each of the apertures B, C and D. Then, short resilient pieces of tubing 58 or the like are introduced over one or both (as shown) ends of each of the pins 55, 57. The outside diameter of the tubing pieces 58 is selected such that each overlaps slightly into the apertures to obtain a friction increasing effect when a solenoid assembly is screwed into an aperture and impinges against the tubing edge. The tubing presses the solenoid casing against the outer threads of the mounting block, the ensuing friction preventing rattling or changes in vertical adjustment. Should dimensions require, the abutting edges of the tubing pieces 58 may distort to permit their residing in the same plane.

In another variation, these plate segments may constitute a portion of a structure cut from a molding whose cross section is, for example, roughly like the cross section of a stove pipe hat, the "brim"being a set of flanges which come to rest against the underside of the keybed adjacent a slot cut therein and the "flat top" of which supports the solenoids. To the inside walls may be affixed components, such as circuit boards.

FIG. 23 shows another variation in which the plate or plate modules may constitute a portion of a structure cut from a molding whose cross section is, for example, roughly like the cross section of a stove pipe or "top hat", the "brim" being a set of flanges 70 which come to rest against the underside of the keybed 1 adjacent a slot 9 cut therein and the "flat top" 71 of which supports the solenoids 3A, 3B. To the inside walls 72, there may be affixed other system components such as circuit boards 73. An optional lower cover 76 may be provided and also may support circuit boards. If desirable, angle iron(s) 74 may be applied to the lower slot corner for keybed reinforcement. This facilitates employing a single slot in the keybed with no reinforcement at the breaks as well as slots large enough to accommodate long note-driver circuit boards. The corners 75 may be routed away to adjust the chassis upward to accommodate various keytail heights and keybed thicknesses. Typically, in this configuration (as will be discussed more fully below), the solenoids are pressed rigidly into the molding and are not adjustable in it although they may be.

The foregoing discussion has been directed to solenoids that screw into the mounting plates; however, another means of engagement between the solenoid casings and the mounting rail or modules is a press-fit. The externally threadless, smooth, cylindrically cased solenoids, assembled, may be forcibly pressed or otherwise fastened into their mounting plate or plates. Alternatively, the solenoid casing may be pressed into the plates before insertion of their coils, and the coils subsequently pressed or otherwise inserted into the casings. In this way, the casings and the plates become a rigid assembly in which heat conductivity between coils, casings and mounting plates is excellent, and therefor heat is harmlessly dissipated. This arrangement has advantages in rapid assembly time provided that a fixed dimensional relationship between the body of the solenoids and position of the mounting plate is acceptable. In retrofit arrangements in which distances between the keybed and the underside of keytails may vary, the mounting plate containing one or more solenoids rigidly pressed into it to a standard short height of protrusion above the plate may, if the plate is of the flat version meant for mounting above or within the top of the keybed, be shimmed up to whatever degree is necessary to achieve the desired permanent proximity of solenoid pusher tips to the keytail underfelts. If the mounting plate is of the "top hat" embodiment or other configuration meant to fasten under the keybed, the mounting plate assembly or assemblies containing one or more solenoids pressed or otherwise rigidly fastened into it to a standard height of protrusion above the plate may be let or inlaid into the keybed from below to whatever degree is necessary to achieve the desired permanent proximity of solenoid pusher tips to the keytail underfelts. With this arrangement, manufacture is easier and less expensive due to elimination of the solenoid height adjustment.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A solenoid stack for a piano comprising:

A) an array of striker solenoid assemblies, each of said striker solenoid assemblies including:

1) a generally cylindrical outer shell;

2) a coil concentrically disposed within said outer shell, said coil having an axial passage extending through its entire length;

3) an inner shell concentrically disposed within said axial passage through said coil;

4) a slug adapted for coaxial translation within said inner shell in response to selective energization and deenergization of said coil; said slug having a coaxial passage through its entire length; said coaxial passage including an internally threaded passage section;

5) a push rod, said push rod being externally threaded along at least a portion of its length and threadedly engaging said threaded passage section of said slug such that an upper end of said push rod extends above said slug; and 6) a thrust member affixed to said upper end of said push rod; and B) a mounting plate structure for supporting said striker solenoid assemblies within a keybed such that each given said solenoid assembly is juxtaposed with respect to an individual keytail in order that said thrust member thereof can deliver a key-impelling stroke to the keytail when said coil of said given solenoid assembly is energized; said mounting plate structure having upper and lower faces and an array of apertures extending between said upper and lower faces, each of said apertures being positioned to reside beneath an individual keytail when installed in the piano keybed and dimensioned to receive said outer shell of a single one of said solenoid assemblies.

2. The solenoid stack of claim 1 in which said outer shell of each of said solenoid assemblies is externally threaded and said apertures are internally threaded.

3. The solenoid stack of claim 1 in which said outer shell of each said solenoid assembly is a press fit within one of said apertures.

4. The solenoid stack of claim 1 in which each said solenoid assembly further includes a stop member having an internally threaded aperture passing therethrough and threadedly engaging a lower region of said push rod, said stop member including a travel-limiting section whose width exceeds the inside diameter of said inner shell.

5. The solenoid stack of claim 2 in which each said solenoid assembly further includes a stop member having an internally threaded aperture passing therethrough and threadedly engaging a lower region of said push rod, said stop member including a travel-limiting section whose width exceeds the inside diameter of said inner shell.

6. The solenoid stack of claim 3 in which each said solenoid assembly further includes a stop member having an internally threaded aperture passing therethrough and threadedly engaging a lower region of said push rod, said stop member including a travel-limiting section whose width exceeds the inside diameter of said inner shell.

7. The solenoid stack of claim 1 in which said thrust member of each said solenoid assembly is dimensioned to be receivable within said inner shell and in which each said solenoid assembly further includes a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug.

8. The solenoid stack of claim 2 in which said thrust member of each said solenoid assembly is dimensioned to be receivable within said inner shell and in which each said solenoid assembly further includes a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug.

9. The solenoid stack of claim 3 in which said thrust member of each said solenoid assembly is dimensioned to be receivable within said inner shell and in which each said solenoid assembly further includes a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug.

10. The solenoid stack of claim 4 in which said thrust member of each said solenoid assembly is dimensioned to be receivable within said inner shell and in which each said solenoid assembly further includes a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug.

11. The solenoid stack of claim 5 in which said thrust member of each said solenoid assembly is dimensioned to be receivable within said inner shell and in which each said solenoid assembly further includes a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug.

12. The solenoid stack of claim 6 in which said thrust member of each said solenoid assembly is dimensioned to be receivable within said inner shell and in which each said solenoid assembly further includes a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug.

13. The solenoid stack of claim 4 which further includes a non-metallic washer situated intermediate said travel-limiting section of said stop member and a lower end of said outer shell.

14. The solenoid stack of claim 5 which further includes a non-metallic washer situated intermediate said travel-limiting section of said stop member and a lower end of said outer shell.

15. The solenoid stack of claim 6 which further includes a non-metallic washer situated intermediate said travel-limiting section of said stop member and a lower end of said outer shell.

16. The solenoid stack of claim 10 which further includes a non-metallic washer situated intermediate said travel-limiting section of said stop member and a lower end of said outer shell.

17. The solenoid stack of claim 11 which further includes a non-metallic washer situated intermediate said travel-limiting section of said stop member and a lower end of said outer shell.

18. The solenoid stack of claim 12 which further includes a non-metallic washer situated intermediate said travel-limiting section of said stop member and a lower end of said outer shell.

19. A solenoid stack for a piano comprising:

A) an array of striker solenoid assemblies, each of said striker solenoid assemblies including:
   1) an outer shell;
   2) a coil disposed within said outer shell, said coil having an axial passage extending through its entire length;
   3) an inner shell concentrically disposed within said axial passage through said coil;
   4) a slug adapted for coaxial translation within said inner shell in response to selective energization and deenergization of said coil;
   5) a push rod affixed to said slug;
   6) a thrust member affixed to said upper end of said push rod, said thrust member being dimensioned to be receivable within said inner shell;
   7) a resilient washer encompassing said push rod and situated beneath and adjacent said thrust member, said resilient washer being sufficiently pliable as to permit its wrapping around said thrust member when said thrust member is pulled into said inner shell by an external force pulling downwardly upon said slug; and
   8) a stop member having an internally threaded aperture passing therethrough and threadedly engaging a lower region of said push rod, said stop member including a travel-limiting section whose width exceeds the inside diameter of said inner shell; and B) a mounting plate structure for supporting said striker solenoid assemblies within a keybed such that each given said solenoid assembly is juxtaposed with respect to an individual keytail in order that said thrust member thereof can deliver a key-impelling stroke to the keytail when said coil of said given solenoid assembly is energized; said mounting plate structure having upper and lower faces and an array of apertures extending between said upper and lower faces, each of said apertures being positioned to reside beneath an individual keytail when installed in the piano keybed and dimensioned to receive said outer shell of a single one of said solenoid assemblies.

20. The solenoid stack of claim 19 which further includes a non-metallic washer situated intermediate said travel-limiting section of said stop member and a lower end of said outer shell.

* * * * *